US010429061B2

(12) United States Patent
DeSellem et al.

(10) Patent No.: US 10,429,061 B2
(45) Date of Patent: Oct. 1, 2019

(54) MATERIAL HANDLING SYSTEM FOR FLUIDS

(71) Applicant: THE BABCOCK & WILCOX COMPANY, Barberton, OH (US)

(72) Inventors: James F DeSellem, Salineville, OH (US); Karl M Heil, North Canton, OH (US); Steven L Osborne, Canal Fulton, OH (US); John A Kulig, Barberton, OH (US); Larry A Hiner, Orrville, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 184 days.

(21) Appl. No.: 15/601,099

(22) Filed: May 22, 2017

(65) Prior Publication Data

US 2017/0343208 A1 Nov. 30, 2017

Related U.S. Application Data

(60) Provisional application No. 62/341,834, filed on May 26, 2016.

(51) Int. Cl.

| | |
|---|---|
| ***F22B 31/00*** | (2006.01) |
| ***F23C 10/08*** | (2006.01) |
| ***F23C 10/26*** | (2006.01) |
| ***F23K 5/10*** | (2006.01) |
| ***F23G 5/30*** | (2006.01) |
| ***F23G 5/44*** | (2006.01) |
| ***F23G 7/02*** | (2006.01) |
| *F23C 10/00* | (2006.01) |

(52) U.S. Cl.

CPC ..... *F22B 31/0084* (2013.01); *F22B 31/0076* (2013.01); *F23C 10/08* (2013.01); *F23C 10/26* (2013.01); *F23G 5/30* (2013.01); *F23G 5/446* (2013.01); *F23G 7/02* (2013.01); *F23K 5/10* (2013.01); *F22B 31/0007* (2013.01); *F23C 10/007* (2013.01); *F23G 2206/10* (2013.01); *F23K 2301/103* (2013.01); *F23K 2301/20* (2013.01)

(58) Field of Classification Search

CPC ..... F22B 31/0084

See application file for complete search history.

(56) References Cited

U.S. PATENT DOCUMENTS 6,002,838 A * 12/1999 Nir ..... F24H 1/208 165/108
6,115,542 A * 9/2000 Nir ..... F23K 5/20 165/108
6,169,273 B1 * 1/2001 Liou ..... F23K 5/04 165/163

(Continued)

*Primary Examiner* — Nathaniel Herzfeld
(74) *Attorney, Agent, or Firm* — Michael J. Seymour

(57) ABSTRACT

Material handling systems for fluids are disclosed herein. The fluid may be a liquid, solution, slurry, or emulsion. The systems receive as inputs the fluid, steam, and water. These feed into a surge tank where additives can be introduced. The steam and water are used to control some physical properties and enable the distribution of the fluid as desired. In particular embodiments, the system is useful for handling materials to be sent to a dual-phase fuel feeder for combustion in a fluidized-bed boiler, the energy being used to generate electricity or in various production processes.

20 Claims, 5 Drawing Sheets

(56) References Cited

U.S. PATENT DOCUMENTS

2002/0158141 A1* 10/2002 Ryu ..... B01F 3/0819
239/102.2
2005/0274308 A1* 12/2005 Copeland ..... F23C 10/30
110/346
2007/0175459 A1* 8/2007 Williams ..... F02D 19/0605
123/575
2007/0277794 A1* 12/2007 Payne ..... F02M 31/10
123/568.15
2010/0325942 A1* 12/2010 Eriksson ..... C10L 1/322
44/307
2011/0036320 A1* 2/2011 Peret ..... C10L 1/00
123/1 A
2011/0259284 A1* 10/2011 Rantee ..... F22B 31/0007
122/22
2013/0180175 A1* 7/2013 Leininger ..... C10J 3/723
48/87
2014/0305357 A1* 10/2014 DeSellem ..... F23C 1/10
110/347

* cited by examiner

MATERIAL HANDLING SYSTEM FOR FLUIDS

BACKGROUND

The present disclosure relates to material handling systems for fluids. The systems affect the physical properties of the fluid (e.g. viscosity) by application of heat, steam, and additives to enhance further downstream processing. It is particularly contemplated that fluid waste streams formed by the production of cellulosic ethanol will be processed herein.

During combustion, the chemical energy in a fuel is converted to thermal heat inside the furnace of a boiler. The thermal heat is captured through heat-absorbing surfaces in the boiler to produce steam. Fuels used in the furnace include a wide range of solid, liquid, and gaseous substances. Combustion transforms the fuel into a large number of chemical compounds. In some applications, solid biomass waste byproducts are used as fuel for the fluidized-bed boiler.

Fluidized-bed boilers are one way to burn solid fuels. Generally speaking, a fluidized-bed boiler includes a bed formed from a stacked height of solid particles. A fluidization gas distribution grid, such as an open bottom system or a flat floor system, is located beneath the bed. An open bottom system is characterized by widely spaced distribution ducts on which are mounted air bubble caps for distributing fluidizing gas (typically air) under pressure to fluidize the bed. In a flat floor system, the distribution ducts form the floor of the boiler. At sufficient gas velocities, the solid particles exhibit liquid-like properties.

With reference to FIG. 1, an illustrative bubbling fluidized-bed (BFB) boiler 8 of a known design (available from The Babcock & Wilcox Company, Barberton, Ohio, USA) includes a bubbling bed 10 onto which fuel 12 is delivered via a feeder 14. The fluidized-bed 10 suitably comprises solid particles such as, for example, sand. A gas-tight furnace flue (only the lower portion of which is shown in FIG. 1) includes gas-tight tube walls 16, 17 made up of tubes through which water flows to cool the walls. A fluidizing gas, such as air, is introduced into the bubbling bed 10 through ducts 18, and spaced-apart bubble caps 20 facilitate removal of large tramp material. In an underbed ash removal system 22, tramp material moves downward and cools before being removed through bottom hoppers 24 onto a suitable conveyor system or the like (not shown). Heat from combustion on the fluidized-bed 10 heats water in the wall tubes 16, 17 which may drive a steam generator or other useful work. In some embodiments, water in the tube walls 16, 17 flows in a closed-loop recirculation path (usually including a make-up water line). The feeder 14 may pass through a non-water cooled refractory furnace wall (e.g., a brick furnace wall) rather than through tube wall 16 as in the illustrative embodiment of FIG. 1, or through any other type of boiler wall. It is contemplated for the furnace wall through which the feeder 14 passes to include additional features such as thermal insulation material, an outer casing, or so forth.

Cellulosic ethanol is an advanced type of biofuel produced from wood, grasses, or the inedible parts of plants. This type of biofuel is produced from lignocellulose, a structural material that comprises much of the mass of plants. Lignocellulose is composed mainly of cellulose, hemicellulose and lignin. Corn stover, switchgrass, miscanthus grass, wood chips, agricultural residue, and even the byproducts of lawn and tree maintenance are some of the feedstock containing lignocellulose.

The production of cellulosic ethanol biofuel typically requires additional processing with specialty chemicals, enzymes, and microorganisms to break down the lignocellulose. As a result, the waste products of cellulosic ethanol production are significantly different from those of the traditional starch ethanol process, which primarily uses cereal grains (e.g. corn kernels) as the feedstock. There are typically two waste streams from the cellulosic ethanol biofuel process. One is a lignin filter cake (cake) with a typical moisture range of 35% to 60% and remainder solids. The second is a syrup with a typical moisture range of 30% to 50% and remainder solids.

It would be desirable to provide systems and methods for handling fluids, such as a waste syrup stream from a cellulosic biofuel production process, which allow those fluids to be delivered to further downstream processes in a desired manner.

BRIEF DESCRIPTION

The present disclosure thus relates to systems and methods for handling fluids, such as those from cellulosic ethanol biofuel waste. In particular embodiments, the fluid is a waste syrup that is fed into a fluidized-bed boiler, which is operated so as to combust these waste products and generate energy. The waste syrup may have a moisture content of about 30% to about 50%. The energy produced therefrom may be in the form of heated gas, steam, or electricity. The energy can be used to power the cellulosic ethanol production processes or other processes.

In additional embodiments, an additive can be introduced to the waste syrup to reduce agglomeration. However, it is generally desired that no further processing needs to be performed with the waste syrup.

Also disclosed herein are liquid material handling systems, comprising: a liquid inlet line; a steam inlet line; a surge tank having a liquid inlet port fluidly connected to the liquid inlet line, a steam inlet port fluidly connected to the steam inlet line, an additive port, a recycle port, and a liquid outlet port; a heater fluidly connected to the liquid outlet port of the surge tank; and a pipe downstream of the heater which splits into (a) a feed line having a pulse valve and leading to at least one feeder outlet line and (b) a return line having a pressure regulating valve and leading to both (i) the recycle port of the surge tank and (ii) storage for the liquid.

The system may further comprise a water inlet line and a cleaning line fluidly connected to both the steam inlet line and the water inlet line. The cleaning line may also be fluidly connected to the at least one feeder outlet line. The surge tank can further comprise a mixer. The feed line may have a pulse valve upstream of the at least one feeder outlet line. In particular embodiments, the at least one feeder outlet line runs to a dual-phase fuel feeder.

Also disclosed herein are methods for preparing a fluid for distribution to a process, comprising: sending the fluid through a fluid inlet line of a material handling system as described above; heating the fluid in the surge tank with steam from the steam inlet line; and sending the heated fluid through the fluid outlet port to the feed line and to the at least one feeder outlet line.

The fluid may be heated in the surge tank to a temperature of about 200° F. or below. If desired, the heated fluid exiting the surge tank can be further heated in the heater to a temperature of about 200° F. or below.

In some embodiments, the feed line has a pulse valve upstream of the at least one feeder outlet line, and the heated fluid can be pulsed, so as to divide the heated fluid into discrete volumes that can reduce agglomeration in further downstream processing.

The fluid can be mixed in the surge tank with an additive. The heated fluid flowing through the return line can be sent to the recycle port of the surge tank, or can be sent to storage.

The material handling system can further comprise (i) a water inlet line and (ii) a cleaning line fluidly connected to both the steam inlet line and the water inlet line. Additional process steps can include sending a water/steam mixture through the cleaning line and through either (i) the feed line or (ii) the return line. The at least one feeder outlet line can run to a dual-phase fuel feeder.

The fluid for distribution may be a liquid, a solution, a slurry, or an emulsion. In particular embodiments, the fluid for distribution is a cellulosic biofuel waste syrup.

These and other non-limiting aspects of the present disclosure are discussed further herein.

BRIEF DESCRIPTION OF THE DRAWINGS

The following is a brief description of the drawings, which are presented for the purposes of illustrating embodiments disclosed herein and not for the purposes of limiting the same.

DETAILED DESCRIPTION

Figure 1:
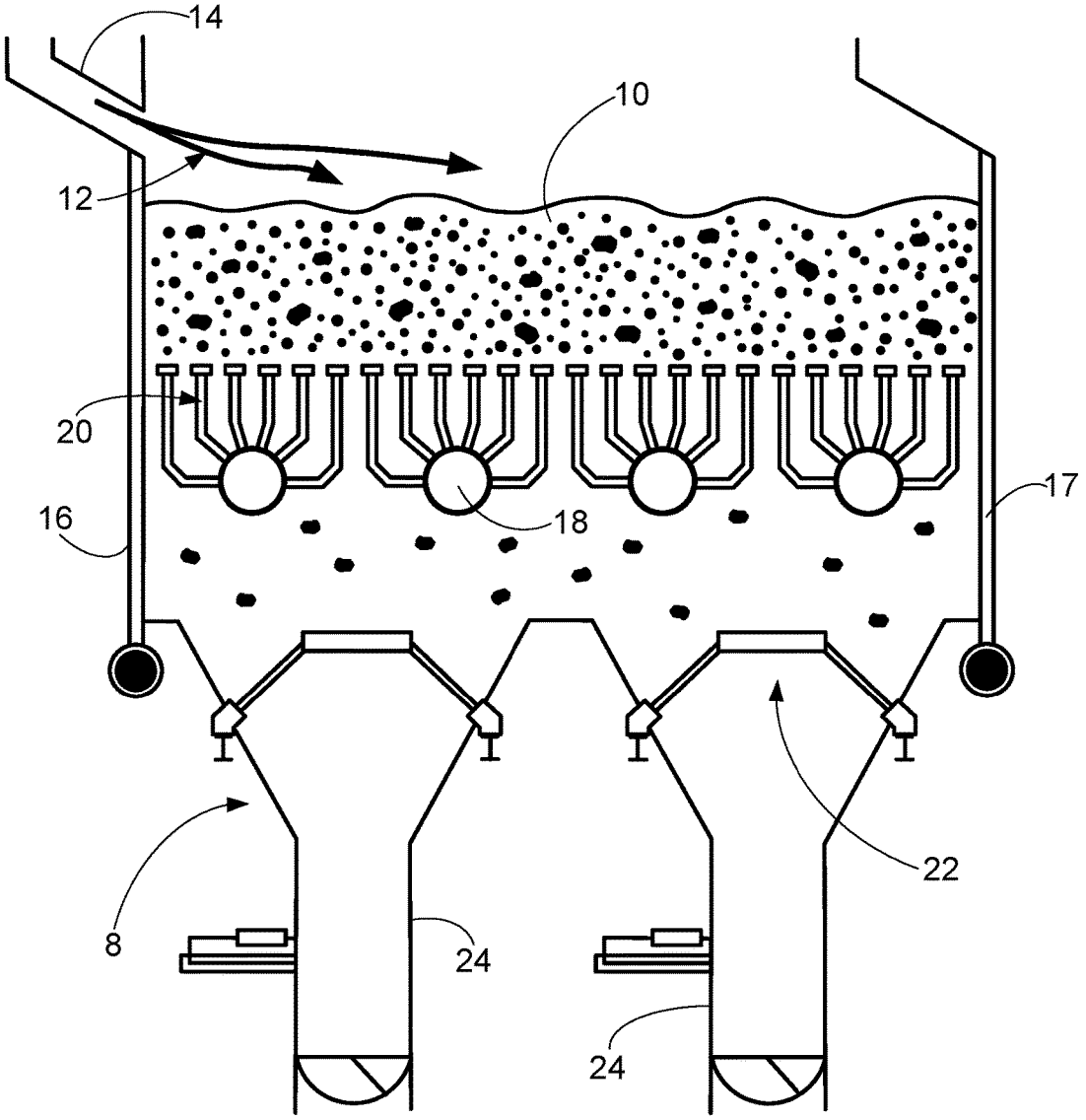
FIG. 1 (PRIOR ART)
FIG. 1 diagrammatically shows an illustrative bubbling fluidized-bed (BFB) boiler of a known design.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such description should be construed as also describing compositions or processes as "consisting of" and "consisting essentially of" the enumerated components/steps, which allows the presence of only the named components/steps, and excludes other components/steps.

All ranges disclosed herein are inclusive of the recited endpoint and independently combinable (for example, the range of "from 2 watts to 10 watts" is inclusive of the endpoints, 2 watts and 10 watts, and all the intermediate values). Numerical values should be understood to include numerical values which are the same when reduced to the same number of significant figures and numerical values which differ from the stated value by less than the experimental error of conventional measurement technique of the type described in the present application to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4."

Some of the terms used herein are relative terms. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the fluids flow through an upstream component prior to flowing through a downstream component. It should be noted that in a loop, a first component can be described as being both upstream of and downstream of a second component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "top" and "bottom" or "base" are used to refer to surfaces where the top is always higher than the bottom/base relative to an absolute reference, i.e. the surface of the earth. The terms "upwards" and "downwards" are also relative to an absolute reference; upwards is always against the gravity of the earth.

To the extent that explanations of certain terminology or principles of the boiler and/or steam generator arts may be necessary to understand the present disclosure, the reader is referred to *Steam/its generation and use,* 42nd Edition, edited by G. L. Tomei, Copyright 2015, The Babcock & Wilcox Company, ISBN 978-0-9634570-2-8, the text of which is hereby incorporated by reference as though fully set forth herein.

The present disclosure relates to a fluid material handling system. The fluid to be handled by the system can be a liquid, a solution, a slurry, or an emulsion. The term "liquid" is used here to refer to the phase of the material (i.e. not a gas, solid, or plasma). The term "solution" refers to a liquid mixture where the solute is substantially uniformly distributed within the solvent. The term "slurry" refers to a mixture of fine particles with a liquid solvent. The term "emulsion" refers to a mixture of two or more liquids that are immiscible with each other, e.g. an oil-water mixture. It is generally contemplated that the term "fluid" refers to a mixture of a liquid with solids, the liquid being the majority of the mixture (by volume or by weight).

Figure 2:
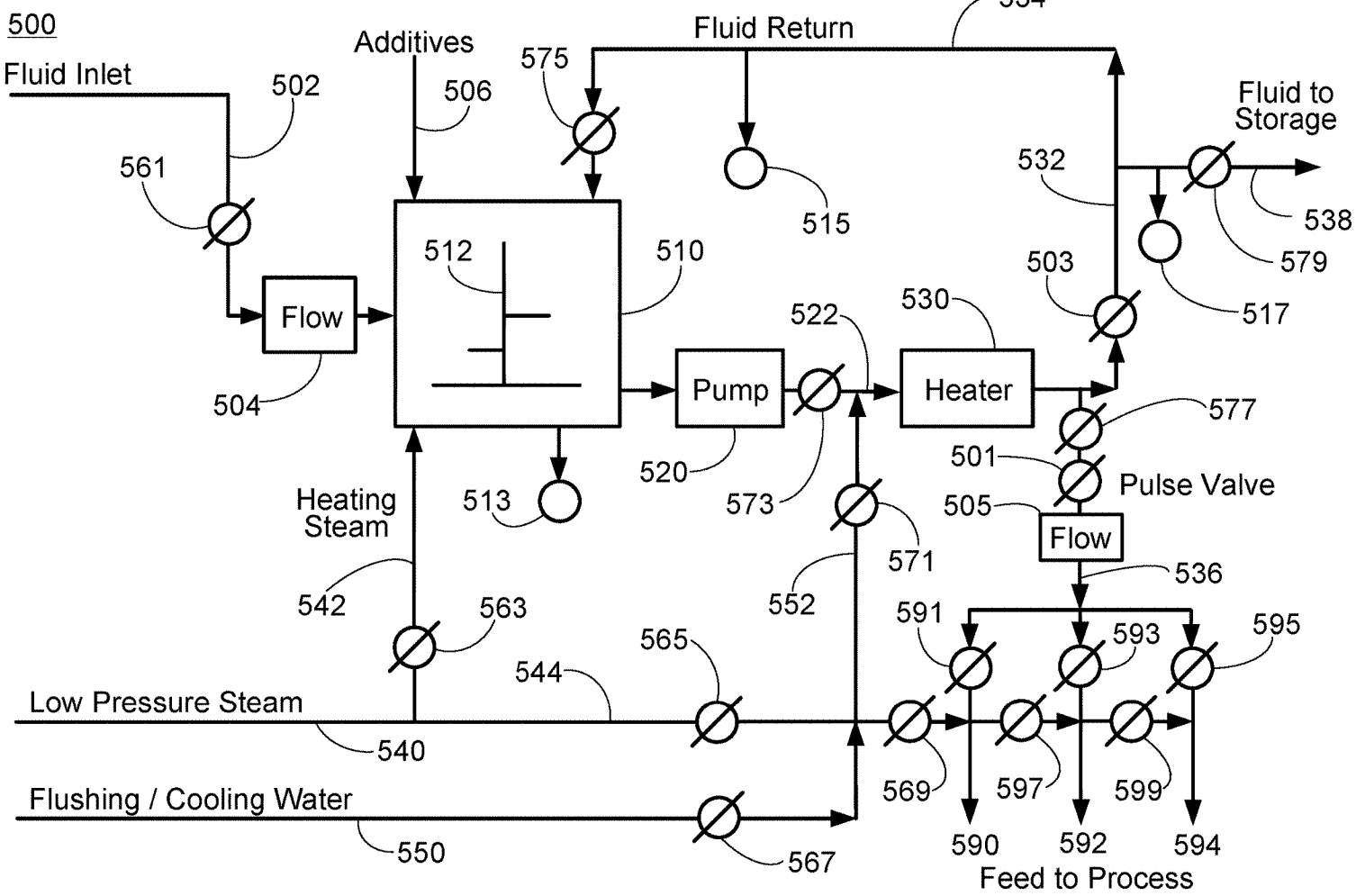
FIG. 2 is a diagram of a fluid material handling system for providing fluid in a desired form to a downstream process.

FIG. 2 is a diagram of a fluid material handling system 500 that can be used to process fluids and change their physical properties (e.g. viscosity, temperature, reactivity, etc.). The system regulates flow, heats the fluid to a desired processing temperature, keeps solids in suspension, allows for system cleaning, allows for rotation between different injection points, and allows for mixing in of additives. The system can be made of corrosion resistant materials, such as stainless steel or chlorinated polyvinyl chloride (CPVC). In this regard, waste syrup is a specifically contemplated fluid that is very corrosive, and has been found in testing to eat through a metal storage drum in only a few weeks.

Beginning at the top left of FIG. 2, a fluid inlet line 502 enters the system and passes through flow meter 504 into surge tank 510. The fluid can be provided from storage or by other means. Low pressure steam enters the system through steam inlet line 540 and enters the surge tank through line/pipe 542 and heats the fluid to a desired temperature. The heating reduces the viscosity of the waste syrup for subsequent processing. In some particular embodiments, the temperature of the fluid in the surge tank (after heating) should not exceed 200° F. or so, and it is contemplated that the temperature of the heated fluid is usually about 100° F. Additive(s) 506 can also be added if desired and mixed with the fluid using mixer 512.

The heated fluid exits the surge tank 510 via pressure applied by pump 520 through line/pipe 522 and passes through heater 530, where the temperature of the heated fluid can be further increased if desired, although again remaining below 200° F. or so.

The heated fluid exits the heater 530 and splits into two lines, a feed line 536 and syrup return line 532. In the feed line 536, a pulse valve 501 is used to create pulses in the heated fluid, and the fluid then passes past flow meter 505. The pulsing may be useful in forming discrete volumes that reduce agglomeration in further downstream processes. The fluid can then be flowed through any number of injection lines to any desired process, these being illustrated as feeder outlet lines 590, 592, 594 (more injection points can be present).

The fluid return line 532 splits into two different lines as well. The fluid can be sent back to storage through line/pipe 538, or can be returned to the surge tank 510 via line/pipe 534, which connects to a recycle port of the surge tank. The endpoints 590, 592, 594, 538 can be considered outlets of the fluid material handling system.

The system includes a cleaning function as well as a means to cool out of service nozzles. As previously mentioned, steam enters through steam inlet line 540. Water enters the system through water inlet line 550. It is noted that the water is typically cool rather than hot/warm. The steam and water can be used separately or combined into a cleaning line 552 that enters the system between the surge tank 510 and the heater 530. The cleaning fluids can then be directed to any desired location, including fluid return to storage line 538 or fluid recycle line 534. Drains 513, 515, and 517 are provided in the surge tank 510, along the fluid recycle line 534, or along the fluid return to storage line 538. The cleaning line of steam and water can also be directed to the injection points 590, 592, 594 by appropriate opening and closing of valves 569, 597, and 599.

Appropriate control systems, piping, and electrical wiring are present for controlling the fluid material handling system 500. Several valves are illustrated in FIG. 2. Valve 561 controls the flow of fluid into the surge tank 510. Valve 563 controls the flow of steam into the surge tank 510. Valve 573 controls the flow of fluid from the surge tank into the remainder of the system.

Valve 565 controls the flow of steam passing through line/pipe 544 into the remainder of the system, and valve 567 controls the flow of water into the system. Valve 571 controls the flow of water and steam into the pipe upstream of the heater. Valves 577 and 503 control the flow of fluid into the injection points to the downstream processes, while valves 591, 593, 595 control each individual injection point. Valve 579 controls the flow of fluid back to storage, and valve 575 controls the flow of fluid into the surge tank 510.

Figure 3:
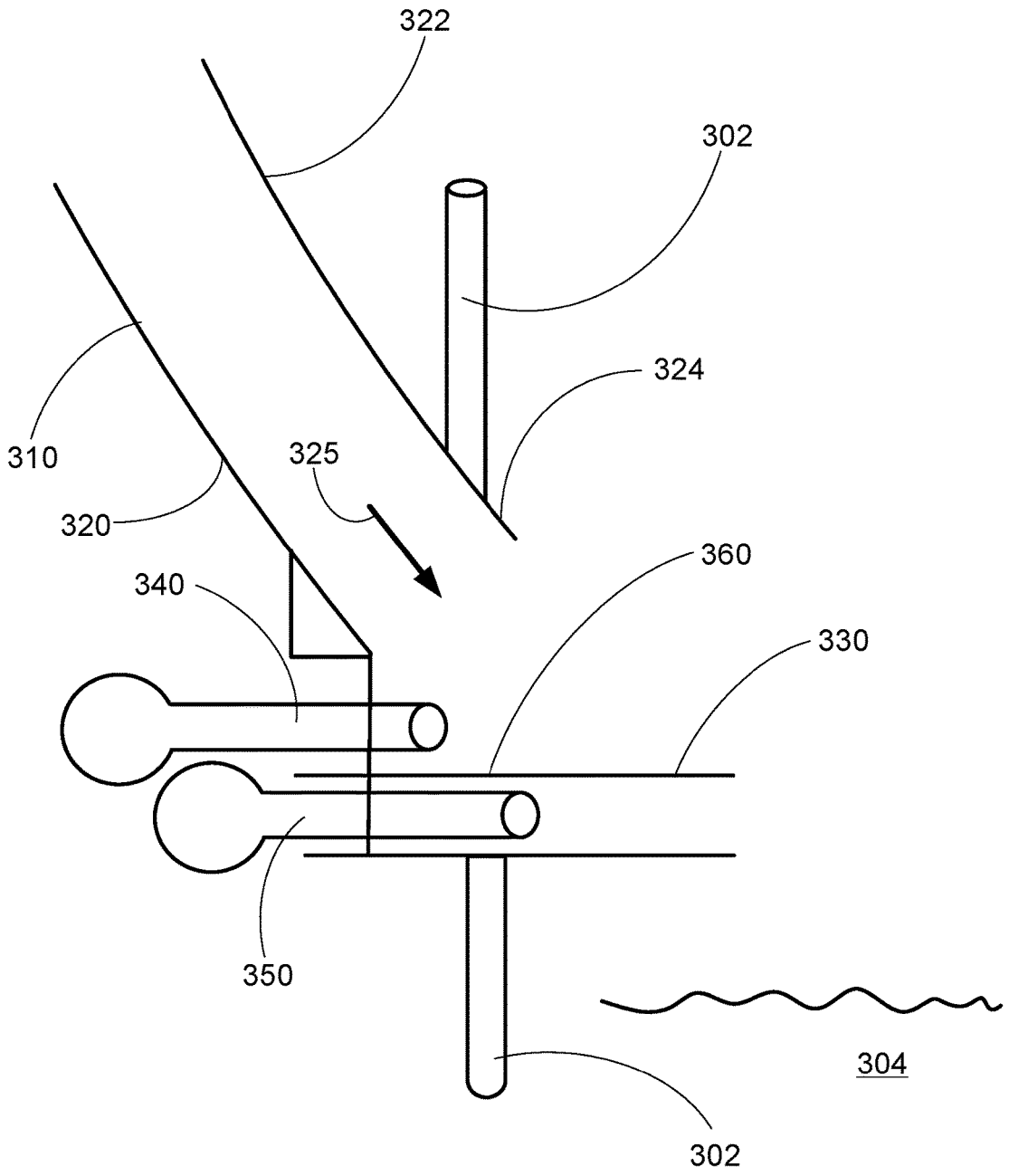
FIG. 3 is a cross-sectional perspective view of a dual-phase fuel feeder that can receive fluid from the system of FIG. 2.

In particular embodiments, it is contemplated that the fluid material handling system provides fluid to a dual-phase fuel feeder that is used with a boiler, such as a fluidized-bed boiler. FIG. 3 is a side cross-sectional view of an illustrative embodiment of a dual-phase feeder 310 which may be useful in the present disclosure. The fuel feeder 310 passes through an opening formed in a furnace tube wall 302 of a boiler which is illustrated for representational purposes with only one tube. Alternatively, the fuel feeder 310 may pass through a refractory (e.g. brick) furnace wall or other type of boiler wall. The fuel feeder 310 includes a sloped chute 320, a set of gas distribution nozzles 340, and a set of secondary nozzles 350. A plate 360 defines the base 330 of the fuel feeder 310. The sloped chute 320 has a top end 322 and a bottom end 324, the bottom end being proximate to the base 330 of the fuel feeder (i.e. plate). Solid fuel follows a solid feed path from the top end 322 to the bottom end 324 and into the boiler. The gas distribution nozzles 340 are located at the base 330 of the fuel feeder 310 and direct a gas into the solid feed path 325. The gas is usually air, though it could also be an oxygen-enriched or oxygen-depleted gas stream. The gas injected via the gas distribution nozzles 340 is used to distribute the solid fuel fed through the chute 320 across the fluidized-bed 304.

Secondary nozzles 350 are also present, and direct the fluid received from the fluid material handling system (of FIG. 2) into the boiler. Here, the secondary nozzles 350 are located below the base 330, so that plate 360 separates the secondary nozzles 350 from the gas distribution nozzles 340. This reduces the effect of gas injected by the gas distribution nozzles 340 on the dispersion of the fluid injected by the secondary nozzles 350, and for example may be useful to reduce the potential effect of atomization of the fluid by interaction with gas from the gas distribution nozzles. It is contemplated that the fluid can be forced through the secondary nozzles via high pressure, such that the fluid exits the secondary nozzles as a coherent stream which is propelled to the fluidized-bed 304. Other dual-phase fuel feeders are disclosed in U.S. Pat. No. 9,482,428 B2, which is hereby fully incorporated by reference in its entirety. As another alternative, the secondary nozzles 350 can be located above the sloped chute 320, so that any solids (i.e. lignin filter cake) fed into the fluidized-bed will not contact the fluid.

As discussed above, the fluid material handling system of FIG. 2 can be used with any liquid, solution, slurry, or emulsion that can be pumped. However, this system is particularly contemplated for use with waste syrup derived from cellulosic biofuel production processes.

In this regard, the cellulosic ethanol biofuel production process is typically more energy intensive than the traditional starch (corn) ethanol production process. Also, the waste products from the cellulosic ethanol biofuel production process are typically not resalable as feed or fertilizer due to their chemistry. These two issues make the use of the cellulosic ethanol biofuel waste streams as a means to generate energy very attractive and potentially a significant contributor to increasing the efficiency and reducing the operating cost/production costs of a cellulosic ethanol biofuel plant.

Figure 4:
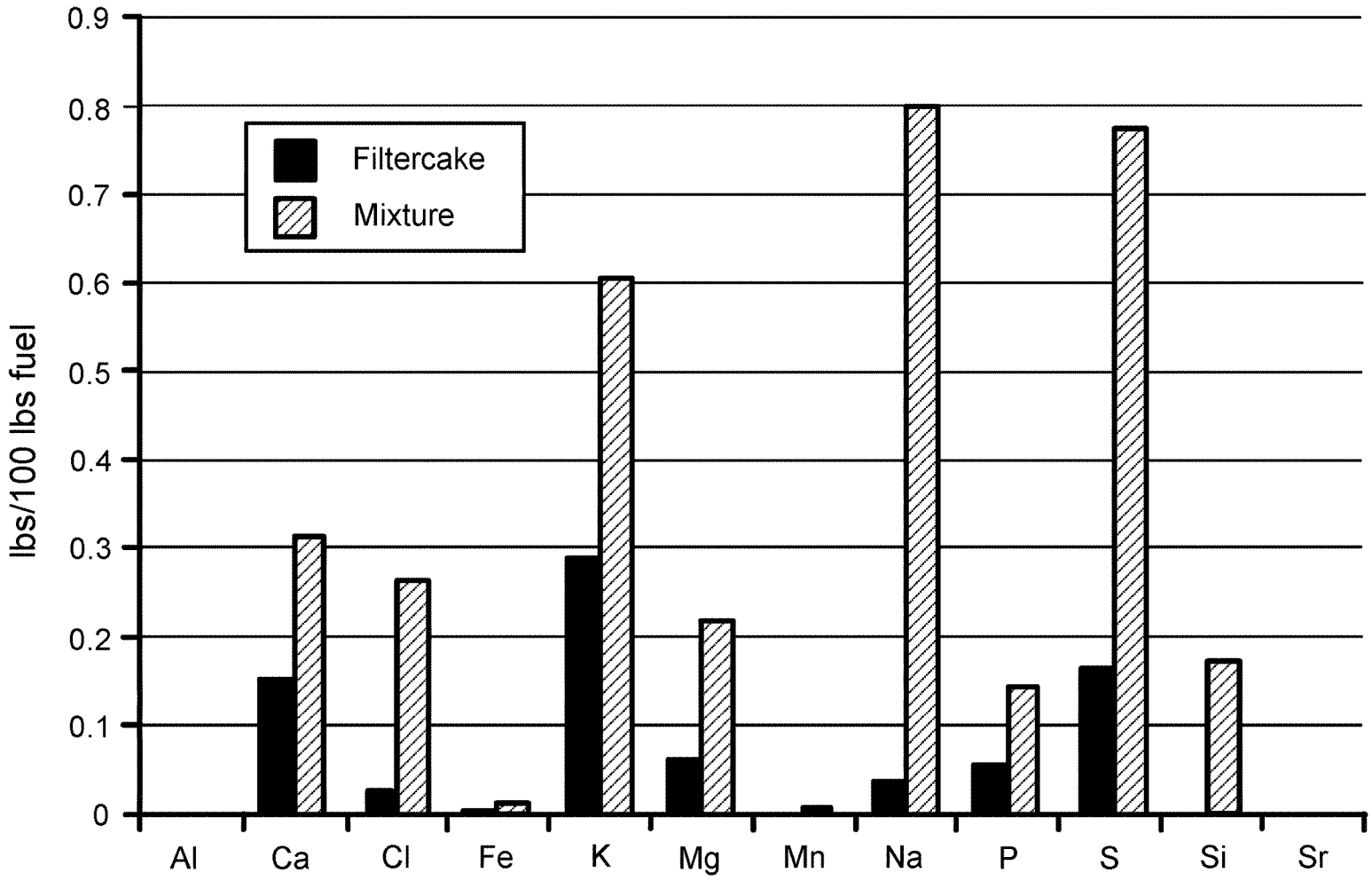
FIG. 4 is a bar graph showing the "reactive" occurrence of elements per 100 lbs fuel input for cellulosic biofuel waste syrup.

A fluidized-bed boiler can be used for combustion of the waste products, which are the lignin filter cake and the waste syrup. When producing ethanol using cellulose as the feedstock, as compared to starch based feedstock, a unique waste is created. The cellulosic waste contains the spent chemicals, enzymes and microorganisms unique to the cellulosic process. The cellulosic process, by design, breaks down the cellulose into a usable form. The breaking down of the cellulose also increases the percentage of elements that are in a reactive form. When elements of a fuel are in a reactive form, they become available for interaction with other elements during the combustion process. Of these elements, the reactive sodium (Na), potassium (K), phosphorus (P), and sulfur (S) are the most problematic. These reactive elements are not only increasing in quantity, but are also being concentrated in the waste syrup. FIG. 4 shows the larger percentage of reactive elements present in the filter cake alone and in the mixture of filter cake and waste syrup. The large difference between the bars shows that these reactive elements concentrated in the syrup. These results were developed using chemical fractionation as a means of analyzing the cake and waste syrup waste. It is intended that these two waste products be used in the form in which they exit the cellulosic ethanol production process. Desirably, no additional processing is needed. Again, the lignin filter cake has a moisture content of about 35% to about 60%, and is generally composed of relatively larger and more solid pieces of cellulose, hemicellulose, and lignin (compared to the syrup). The waste syrup has a moisture content of about 30% to about 50%.

The boiler can be, for example, a bubbling fluidized-bed (BFB), a circulating fluidized-bed (CFB), a stoker-fired boiler, or other fluidized-bed boiler. This boiler is comprised of a membrane-walled gas-tight enclose. A membrane wall design offers the advantage of a lower weight compared with a refractory-lined steel shell to achieve the same external shell temperature. A lower weight design has a lower capital cost compared with a refractor-lined shell design. The boiler includes a solid fuel feeder through which the relatively solid lignin filter cake can be introduced into the boiler. The solid fuel feeder may be a conventional solid-phase fuel feeder, or can be a dual-phase fuel feeder that is used to introduce both solid-phase lignin filter cake and liquid-phase waste syrup into the boiler.

In particular, the waste syrup should be injected into the fluidized-bed separately from the lignin filter cake and should not be burned in suspension. The waste syrup is desirably burned in the fluidized-bed or in the freeboard (the volume between the top of the expanded fluidized-bed and the convection surfaces). This is because the waste syrup exhibits a phase shift where the suspended solids enter a "plastic" phase when subjected to temperatures of above 250° F. and the moisture is driven off. The solids in the syrup appear to remain in this plastic phase through most, if not all, of the devolatilization phase. This plastic phase delays the combustion process sufficiently such that plastic phase particles, when burned in suspension, have enough time to become attached to any proximate surface or bed particles, leading to severe fouling and agglomeration. Field testing indicates that combining the waste syrup with solid fuels (e.g. lignin filter cake) above 10% did not work well.

Figure 5:
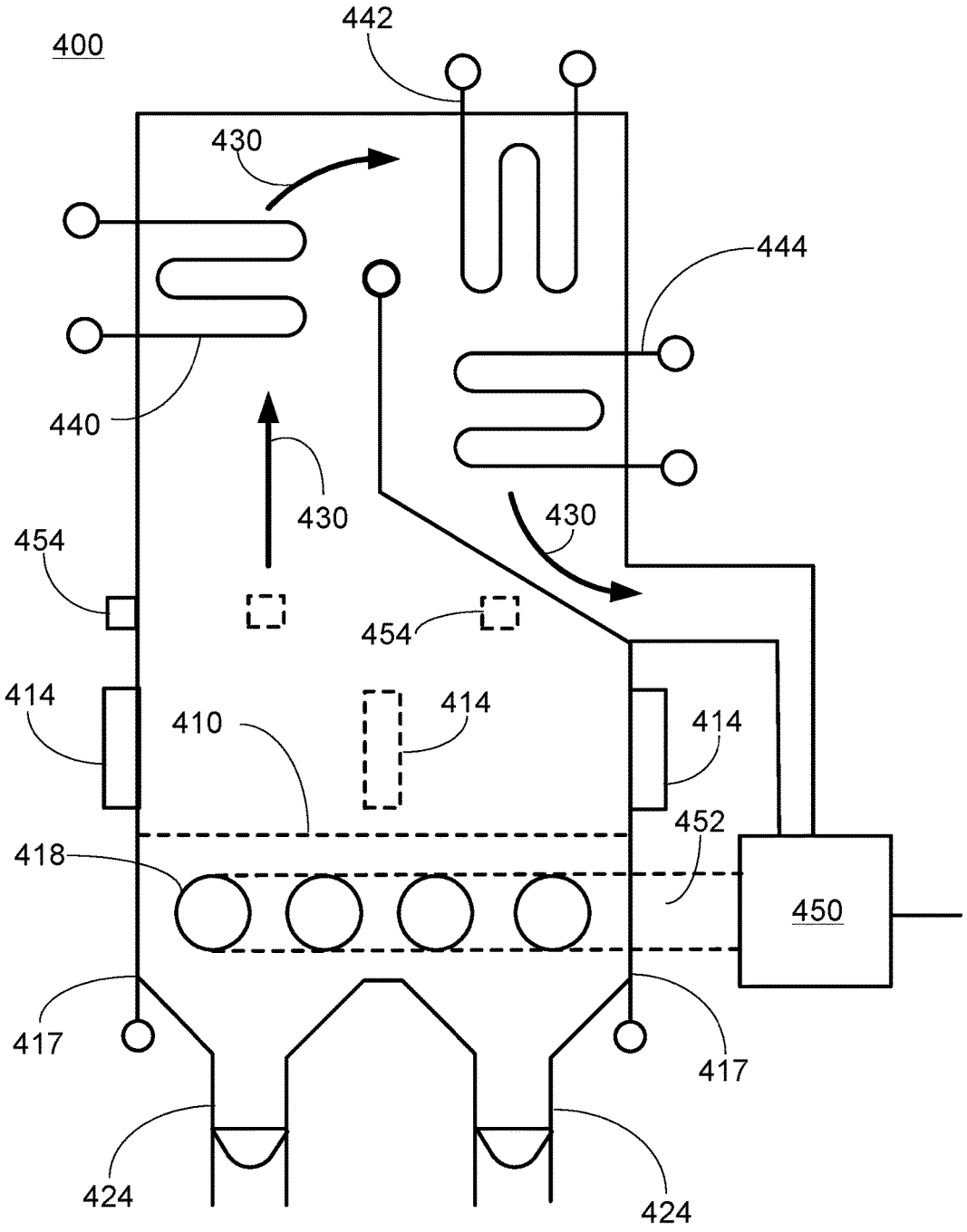
FIG. 5 is a schematic diagram of a fluidized-bed boiler with which the fluid material handling system of FIG. 2 can be used.

FIG. 5 is a schematic diagram of a fluidized-bed boiler 400 that is used to illustrate some aspects of the methods of operation of the present disclosure. Initially, the boiler includes a fluidized-bed 410. The fluidized-bed is surrounded by water cooled walls 417. Three fuel feeders 414 are illustrated for feeding fuel to the fluidized-bed. Air ducts 418 provide the air for fluidizing the bed material, and bottom hoppers 424 are used for removing bed material for various purposes.

The fluidized-bed is operated at a temperature of about 1200° F. to about 1500° F. The flue gas pathway is illustrated by dark arrows 430. Heat energy from the flue gas is captured via superheater 440, reheater 442, and economizer 444. The flue gas then passes through an air preheater 450. Flue gas exiting the boiler may be recirculated as the fluidizing medium of the fluidized-bed. As illustrated here, some of the flue gas passing through air preheater 450 can be redirected to the air ducts 418 via line/pipe 452. Flue gas recirculation can be used to control the intensity of fluidization and primary zone stoichiometry while maintaining the target temperature of the fluidized-bed. Flue gas has a much lower oxygen concentration compared to air, and varying the ratios of flue gas/air in the fluidizing gas allows the bed temperature and the superficial bed velocity to be controlled over a wider range. It is essential to control bed temperature in a desired range to avoid agglomeration when firing fuels high in sodium and potassium. Severe agglomeration can occur at typical fluidized-bed temperatures of 1500° F. to 1600° F. when firing cellulosic ethanol byproduct fuels. By incorporating flue gas recirculation, it is possible to maintain the desired fluidizing gas velocity to promote good mixing and combustion while optimizing the total available oxygen to moderate combustion and lower the fluidized-bed temperature below the agglomeration temperature. The balance of required air to complete combustion is introduced through secondary air ports 454.

As described, the fluidized-bed temperature can be controlled. The fluidization intensity (e.g. bubbling bed vs. circulating bed) can also be controlled. These parameters aid in controlling the rate and size of the agglomerations that are formed by the plastic phase of the waste syrup to an acceptable level that can be continuously removed with a bed material reclamation system.

The waste syrup is processed using the fluid material handling system of FIG. 2 to obtain a desired form (e.g. lower viscosity, containing additives, etc.). Referring back to FIG. 5, the waste syrup is then injected into the fluidized-bed as a liquid stream, with no atomization desired. The waste syrup liquid stream is directed to the plan area of the fluidized-bed as a single stream or multiple streams dependent on the quantity of syrup injected.

Usually, concentrating a liquid fuel in one or more locations (rather than evenly distributing the liquid fuel throughout the bed) is undesirable because the combustion chemistry can be very different compared to the rest of the bed, and because agglomeration of bed material can result. However, with the waste syrup from cellulosic ethanol production, concentration in one or more discrete locations permits the characteristic of the syrup transforming into a plastic phase to be exploited. Much of the problematic chemistry with the waste syrup (due to the spent chemicals, enzymes, micro-organism byproducts, and reactive elements) can be confined in the agglomerations formed by the plastic phase in the discrete location(s), rather than be distributed throughout the fluidized-bed. The agglomerations can then be continuously removed during normal operation (e.g. via hoppers 424 illustrated in FIG. 5). Desirably, the total concentration of alkali species (Na+K) and phosphorus within the fluidized-bed should be less than 5% by weight Na+K+P. An acceptable bed drain rate of 10% was demonstrated at a pilot facility to control the rate of agglomeration formation. In alternate embodiments, the commercial bed drain rate can range from about 2.5% to about 10%. The bed drain rate refers to percent of the total mass of the fluidized-bed material, shown as 410 in FIG. 5, that is drained every hour.

One technique for determining the onset of agglomeration within the fluidized-bed is performed using high speed primary zone differential pressure measurements. The primary zone consists of the region of the fluidized-bed boiler below the over-fire air ports as indicated by reference numeral 454 in FIG. 5. The pressure drop across the fluidized-bed of solids (410 in FIG. 5) is measured with high speed pressure transducer(s). The resultant signal is analyzed to identify a deviation from a Gaussian distribution of pressure fluctuations. The bed drain rate can then be adjusted to manage agglomeration formation while minimizing the addition of fresh bed material.

If the furnace wall and heating surface temperatures are maintained below 1000° F., acceptable slagging and fouling rates are obtained. Additional absorption surfaces (such as wing walls) can be incorporated into the boiler, or the residence time of the fuel can be adjusted, to ensure adequate burnout of the fuel while inhibiting slagging and fouling.

If desired, an additive can be mixed together with the waste syrup prior to introducing the waste syrup into the boiler. This mixing can be performed in the surge tank 510 of FIG. 2. The additive would raise the eutectic temperature of the ash, and reduce the agglomeration tendency of the syrup. However, this would increase operating costs and must be weighed against the cost of the bed material make-up due to agglomeration removal.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A fluid material handling system, comprising:
- a fluid inlet line;
- a steam inlet line;
- a surge tank having a fluid inlet port fluidly connected to the fluid inlet line, a steam inlet port fluidly connected to the steam inlet line, an additive port, a recycle port, and a fluid outlet port;
- a heater fluidly connected to the fluid outlet port of the surge tank; and
- a pipe downstream of the heater which splits into (a) a feed line leading to at least one feeder outlet line and (b) a return line having a pressure regulating valve and leading to both (i) the recycle port of the surge tank and (ii) storage for the fluid.

2. The system of claim 1, wherein the feed line has a pulse valve upstream of the at least one feeder outlet line.

3. The system of claim 1, further comprising (i) a water inlet line and (ii) a cleaning line fluidly connected to both the steam inlet line and the water inlet line.

4. The system of claim 3, wherein the cleaning line is fluidly connected to the at least one feeder outlet fine.

5. The system of claim 1, wherein the surge tank further comprises a mixer.

6. The system of claim 1, wherein the at least one feeder outlet line runs to a dual-phase fuel feeder.

7. The system of claim 6, wherein the dual-phase feeder comprises:
- a plate defining a base of the dual-phase feeder;
- a sloped chute having a top end and a bottom end;
- a plurality of gas distribution nozzles, each gas distribution nozzle of the plurality of gas distribution nozzles comprising a gas distribution outlet located below the bottom end of the sloped chute and above the plate; and
- a plurality of secondary nozzles, each secondary nozzle of the plurality of secondary nozzles comprising a secondary outlet located below the plate.

8. The system of claim 6, wherein the dual-phase feeder comprises:
- a sloped chute for feeding a solid fuel to a boiler; and
- secondary nozzles located above the sloped chute for directing a fluid into the boiler.

9. A method for preparing a fluid for distribution to a process, comprising:
- sending the fluid through a fluid inlet line of a material handing system that comprises:
- the fluid inlet line;
- a steam inlet line;
- a surge tank having a fluid inlet port fluidly connected to the fluid inlet line, a steam inlet port fluidly connected to the steam inlet line, an additive port, a recycle port, and a fluid outlet port;
- a heater fluidly connected to the fluid outlet port of the surge tank; and
- a pipe downstream of the heater which splits into (a) a feed line leading to at least one feeder outlet line and (b) a return line having a pressure regulating valve and leading to both (i) the recycle port of the surge tank and (ii) storage for the fluid;
- heating the fluid in the surge tank with steam from the steam inlet line; and
- sending the heated fluid through the fluid outlet port to the feed line and to the at least one feeder outlet line.

10. The method of claim 9, wherein the fluid is heated in the surge tank to a temperature of about 200° F. or below.

11. The method of claim 9, wherein the heated fluid exiting the surge tank is further heated in the heater to a temperature of about 200° F. or below.

12. The method of claim 9, wherein the feed line has a pulse valve upstream of the at least one feeder outlet line, and further comprising pulsing the heated fluid.

13. The method of claim 9, further comprising mixing the fluid in the surge tank with an additive.

14. The method of claim 9, wherein heated fluid flowing through the return line is sent to the recycle port of the surge tank.

15. The method of claim 9, wherein heated fluid flowing through the return line is sent to storage.

16. The method of claim 9, wherein the material handling system further comprises (i) a water inlet line and (ii) a cleaning line fluidly connected to both the steam inlet line and the water inlet line; and
- further comprising sending a water/steam mixture through the cleaning line and through either (i) the feed line or (ii) the return line.

17. The method of claim 9, wherein the at least one feeder outlet line runs to a dual-phase fuel feeder.

18. The method of claim 9, wherein the fluid for distribution is a liquid, a solution, a slurry, or an emulsion.

19. The method of claim 9, wherein the fluid for distribution is a cellulosic biofuel waste syrup.

20. The method of claim 17, wherein the dual-phase feeder comprises:

a plate defining a base of the dual-phase feeder;

a sloped chute having a top end and a bottom end;

a plurality of gas distribution nozzles, each gas distribution nozzle of the plurality of gas distribution nozzles comprising a gas distribution outlet located below the bottom end of the sloped chute and above the plate; and a plurality of secondary nozzles, each secondary nozzle of the plurality of secondary nozzles comprising a secondary outlet located below the plate.

* * * * *